US009648419B2

(12) United States Patent
Tan et al.

(10) Patent No.: US 9,648,419 B2
(45) Date of Patent: May 9, 2017

(54) APPARATUS AND METHOD FOR COORDINATING USE OF DIFFERENT MICROPHONES IN A COMMUNICATION DEVICE

(71) Applicant: MOTOROLA SOLUTIONS, INC, Schaumburg, IL (US)

(72) Inventors: Cheah Heng Tan, Bayan Lepas (MY); Kheng Shiang Teh, Bayan Lepas (MY); Pek Bing Teo, Penang (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 16 days.

(21) Appl. No.: 14/539,739

(22) Filed: Nov. 12, 2014

(65) Prior Publication Data

US 2016/0134956 A1 May 12, 2016

(51) Int. Cl.

| | |
|---|---|
| ***H04R 3/00*** | (2006.01) |
| *H04R 1/10* | (2006.01) |
| *G10L 25/84* | (2013.01) |

(52) U.S. Cl.

CPC ..... *H04R 3/005* (2013.01); *G10L 25/84* (2013.01); *H04R 1/1041* (2013.01); *H04R 2410/05* (2013.01); *H04R 2460/13* (2013.01)

(58) Field of Classification Search

CPC ..... H04R 5/033; H04R 5/0335
USPC ..... 381/94.1–94.7, 123
See application file for complete search history.

(56) References Cited

U.S. PATENT DOCUMENTS

| | | | |
|---|---|---|---|
| 4,084,139 | A | 4/1978 | Jakobe |
| 5,457,751 | A | 10/1995 | Such |
| 5,884,198 | A | 3/1999 | Kese et al. |
| 5,956,630 | A | 9/1999 | Mackey |
| 6,805,519 | B1 | 10/2004 | Courtney |
| 7,570,977 | B2 | 8/2009 | Gantz et al. |
| 7,587,227 | B2 | 9/2009 | Cheung et al. |
| 7,720,234 | B1 | 5/2010 | Winslow et al. |
| 7,983,428 | B2 | 7/2011 | Ma et al. |
| 7,983,907 | B2 | 7/2011 | Visser et al. |
| 8,308,641 | B2 | 11/2012 | Moroney, III et al. |

(Continued)

FOREIGN PATENT DOCUMENTS

| | | |
|---|---|---|
| EP | 872155 A1 | 9/1996 |
| EP | 2555189 A1 | 2/2013 |

(Continued)

*Primary Examiner* — Disler Paul

(74) *Attorney, Agent, or Firm* — Barbara R. Doutre; Neal Blibo LLC

(57) ABSTRACT

A communication device is configured to receive signals using at least one acoustic microphone and at least one structural microphone. The communication device calculates one of first a signal-to-noise (SNR) ratio and a speech-to-noise ratio for the at least one acoustic microphone from received signals and calculates a SNR for the at least one structural microphone from received signals. The communication device compares one of the first SNR and the speech-to-noise ratio for the at least one acoustic microphone with the SNR for the at least one structural microphone. The communication device selects one of the at least one acoustic microphone and at least one structural microphone to receive speech responsive to the comparing and places a selected one of the at least one acoustic microphone and at least one structural microphone in a standby mode.

21 Claims, 4 Drawing Sheets

(56) References Cited

U.S. PATENT DOCUMENTS

| | | | | |
|---|---|---|---|---|
| 8,442,244 | B1 | 5/2013 | Long, Jr. | |
| 8,781,142 | B2 | 7/2014 | Olafsson et al. | |
| 8,792,648 | B2 | 7/2014 | Kim et al. | |
| 9,124,965 | B2 * | 9/2015 | Heiman | H04R 1/00 |
| 2002/0110252 | A1 * | 8/2002 | Liu | H04R 1/083 381/120 |
| 2004/0203414 | A1 | 10/2004 | Satou et al. | |
| 2009/0190769 | A1 * | 7/2009 | Wang | H03G 3/32 381/66 |
| 2009/0274335 | A1 * | 11/2009 | Cheung | H04R 5/0335 381/374 |
| 2011/0135108 | A1 * | 6/2011 | Chien | H04R 1/1041 381/74 |
| 2013/0322643 | A1 | 12/2013 | Every et al. | |
| 2014/0078462 | A1 | 3/2014 | Abreu | |
| 2014/0126756 | A1 | 5/2014 | Gauger, Jr. | |
| 2014/0192998 | A1 | 7/2014 | Burnett | |

FOREIGN PATENT DOCUMENTS

| | | | |
|---|---|---|---|
| WO | 02054711 | A3 | 7/2002 |
| WO | 2014041032 | A1 | 3/2014 |

* cited by examiner

APPARATUS AND METHOD FOR COORDINATING USE OF DIFFERENT MICROPHONES IN A COMMUNICATION DEVICE

BACKGROUND OF THE INVENTION

A communication device, such as a radio, may include one or more microphones for receiving speech from a user of the communication device. Typically, the communication device includes one or more acoustic microphones through which sound waves are converted into electrical signals, which may then be amplified, transmitted, or recorded. Acoustic microphones are configured to receive ambient environmental noise in addition to the user's speech. In a noisy environment, for example, next to a highway or in a loud manufacturing plant, the ambient environmental noise level may be louder than speech signals received by the acoustic microphones. When the ambient environmental noise level is relatively loud in comparison with the user's speech, a receiver of the user's speech may be unable to understand the speech.

Some communication devices are configured with one or more structural microphones. Structural microphones are vibration sensitive microphones that can receive the user's speech based on coupling of vibration generated when the user speaks. More particularly, while acoustic microphones generate sound by receiving vibrations from the air, a structural microphone receive a signal directly from vibration of physical matter such as bone, flesh, plastic, or any solid structure, and not from the air. Therefore, structural microphones differ from acoustic microphones in that they generate sound from direct coupling to physical matter.

However, speech obtained with a structural microphone is unnatural, i.e., the speech does not have the natural properties or qualities of speech obtained with an acoustic microphone. For example, speech obtained with a structural microphone may be muffled or sound like machine generated speech and may include no or relatively little ambient environmental noise.

To improve usability of the communication device, in some environments, the communication device may be configured to be attached to the user's body. For instance, in a gaming application, the communication device may include one or more structural microphones and may be wearable on the user's neck, thereby free the user's hands for other use. In such a case, the user's speech may be obtained by the structural microphone in the communication device. The structural microphone may obtain the speech based on vibrations from the user's neck that is generated from the user's throat and vocal cord while the user is speaking. In another case, the communication device may be worn on the user's head, wherein the structural microphone may obtain the user's speech based on vibrations from the user's head that is generated while the user is speaking. In both examples, the speech obtained by the communication device through the structural microphone lack the natural properties or qualities of speech obtained with an acoustic microphone. There is currently no communication device that is configured to reduce, if necessary, the ambient environmental noise level received by an acoustic microphone in order to improve communications between a sender and a receiver while addressing the speech quality of speech obtained with a structural microphone.

Accordingly, there is a need for an apparatus and method for coordinating the use of different microphones in a communication device and for addressing the speech quality of each of the microphones.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
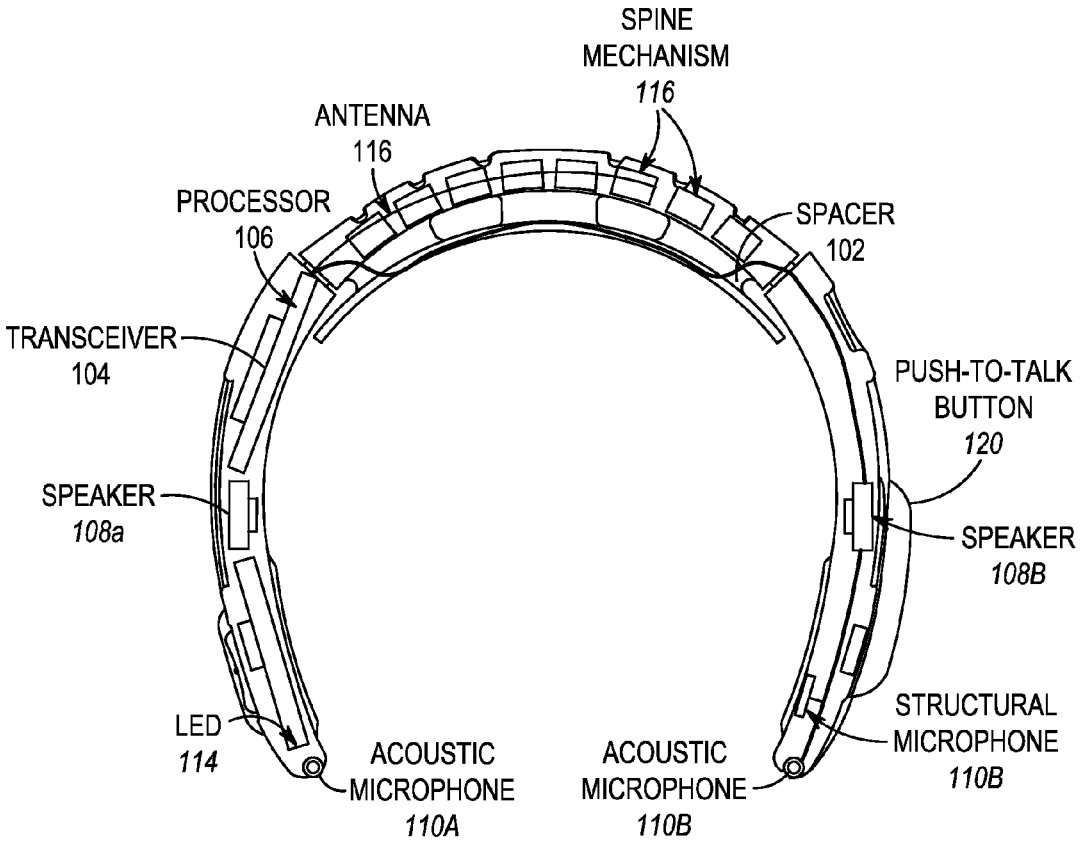
FIG. 1 is a block diagram of a communication device used in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Some embodiments are directed to apparatuses and methods for selecting either an acoustic microphone or a structural microphone in a communication device. The communication device is configured to receive signals using at least one acoustic microphone and at least one structural microphone. The communication device calculates one of first a signal-to-noise (SNR) ratio and a speech-to-noise ratio for at least one acoustic microphone from received signals and calculates a SNR for at least one structural microphone from received signals. The communication device compares one of the first SNR and the speech-to-noise ratio for at least one acoustic microphone with the SNR for at least one structural microphone. The communication device selects one of at least one acoustic microphone and at least one structural microphone to receive speech responsive to the comparing and places a selected one of at least one acoustic microphone and at least one structural microphone in a standby mode.

FIG. 1 is a block diagram of a communication device used in accordance with some embodiments. Communication device 100 is configurable to be attached to a body of a user of communication device 100. For example, communication device 100 may be worn on the neck of a user, i.e., on a part of the user's body that is closest to the user's mouth and ear so that audio received by communication device 100 can be transmitted to the user's ear and speech from the user can be transmitted by communication device 100 without the use of additional equipment and/or without the user having to hold the communication device.

Communication device 100 includes spacers 102, at least one transceiver 104, at least one processor 106, dual speakers 108 (i.e., speaker 108*a* and 108*b*), at least one acoustic microphone 110 (i.e., acoustic microphone 110*a* and 110*b*), and a structural microphone 112. Communication device 100 may also include a light-emitting diode (LED) 114 at one or both tips to provide lighting. Communication device 100 may further include an antenna 116 to provide radio frequency (RF) coverage and a push-to-talk 120 button to enable push-to-talk communication. Communication device 100 may include other features, for example, a battery and a power button, that are not shown for ease of illustration.

Spacers 102 are configured to form communication device 100 into a shape. For instance, spacers 102 may form communication device 100 into u-shaped device, wherein spacers 102 are adjustable using a spine mechanism 118 to account for various neck sizes. Antenna 116 may be inserted between spine mechanism 118. The spacers also separates the antenna from the user to avoid RF desense. The transceiver 104 may be one or more broadband and/or narrowband transceivers, such as an Long Term Evolution (LTE) transceiver, a Third Generation (3G) (3GGP or 3GGP2) transceiver, an Association of Public Safety Communication Officials (APCO) Project 25 (P25) transceiver, a Digital Mobile Radio (DMR) transceiver, a Terrestrial Trunked Radio (TETRA) transceiver, a WiMAX transceiver perhaps operating in accordance with an IEEE 802.16 standard, and/or other similar type of wireless transceiver configurable to communicate via a wireless network for infrastructure communications. The transceiver 104 may also be one or more local area network or personal area network transceivers such as Wi-Fi transceiver perhaps operating in accordance with an IEEE 802.11 standard (e.g., 802.11a, 802.11b, 802.11g), or a Bluetooth transceiver.

The processor 106 may include, that is, implement, an encoder/decoder with an associated code read-only memory (ROM) for storing data for encoding and decoding voice, data, control, or other signals that may be transmitted or received by communication device 100. The processor 106 may further include one or more of a microprocessor and digital signal processor (DSP) coupled, by a common data and address bus, to the encoder/decoder and to one or more memory devices, such as a ROM, a random access memory (RAM), and a flash memory. One or more of the ROM, RAM and flash memory may be included as part of processor 106 or may be separate from, and coupled to, the processor 106. The encoder/decoder may be implemented by the microprocessor or DSP, or may be implemented by a separate component of the processor 106 and coupled to other components of processor 106 via the common data and address bus.

Figure 2A:
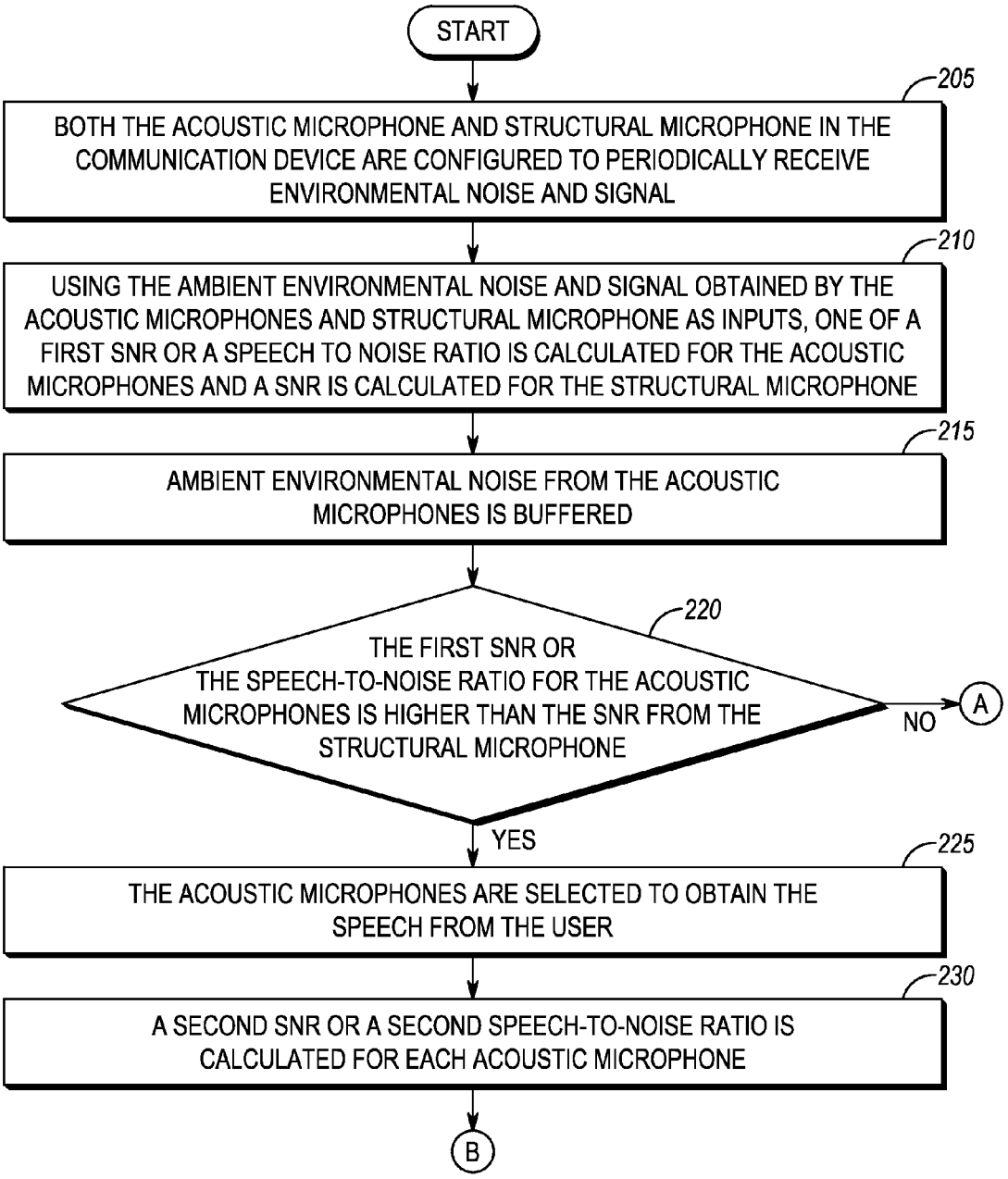
FIGS. 2A and 2B are flow diagrams of a method of selecting one of an acoustic microphone and a structural microphone in a communication device in accordance with some embodiments.
Figure 2B:
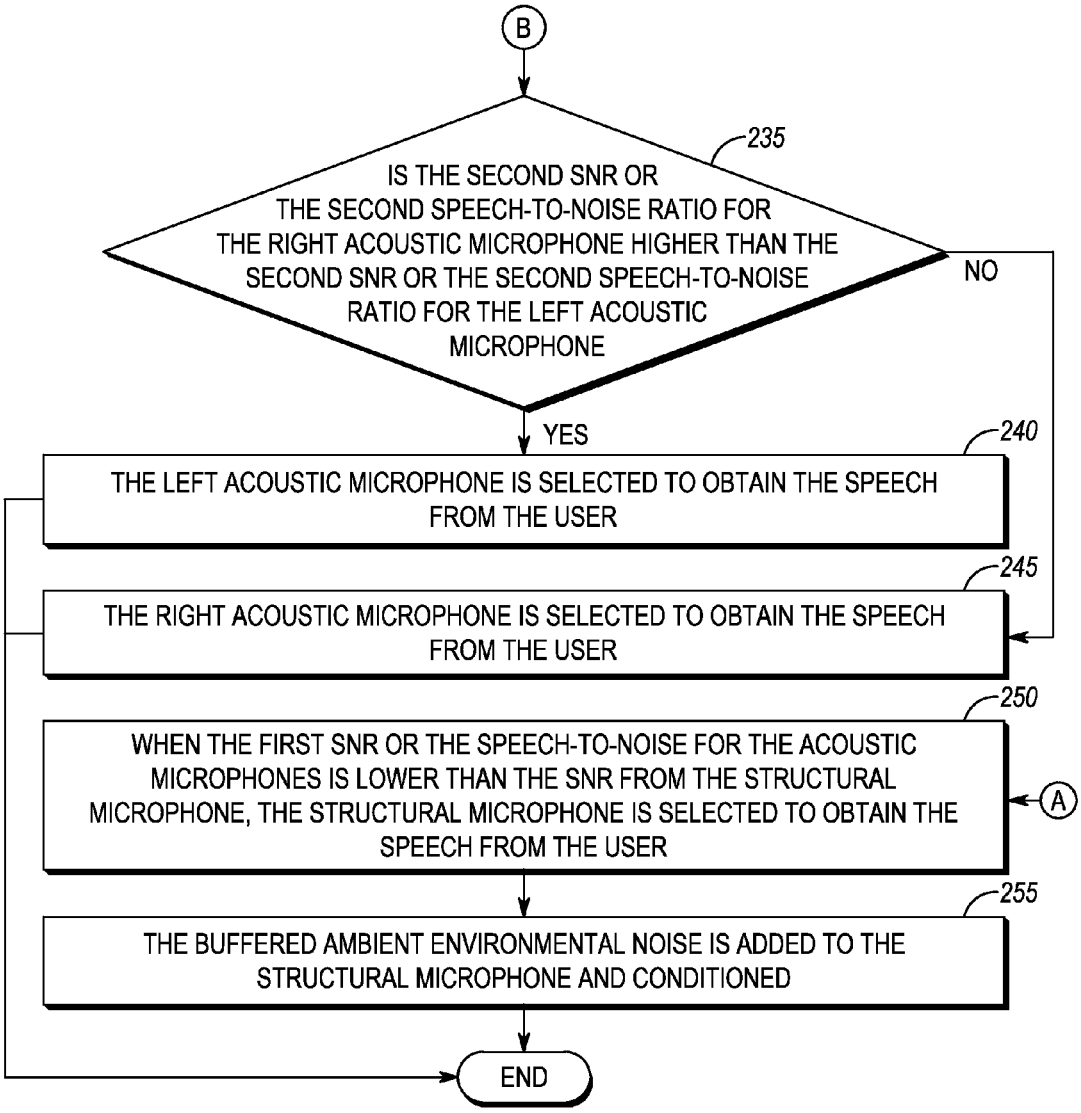

One or more of the memory devices may store code for decoding or encoding data such as control, request, or instruction messages, channel change messages, and/or data or voice messages that may be transmitted or received by communication device 100 and other programs and instructions that, when executed by the processor 100, provide for the communication device 100 to perform a set of functions and operations described herein as being performed by such a device, such as the implementation of the encoder/decoder and one or more of the steps set forth in FIG. 2.

Dual speakers 108 are configured to send information received by communication device 100 to the user's ears. Due to distance between the speakers 108 and the user's ears, the size of speakers 108 do not need to be large because of the advantage of the binaural phycho-acoustical loudness summation effect inside the head of the user where audio signal is perceived to the louder compared to a single speaker.

Acoustic microphones 110 may be incorporated on a left side and a right side of communication device 100. For example, acoustic microphones 110*a* may be incorporated in the left tip of communication device 100 and acoustic microphone 110*b* may be incorporated in the right tip of communication device 100 to provide for robust head-turning acoustic reception. Structural microphone 112 may be incorporated in the left and/or right side of communication device 100. Although in FIG. 1, only one structural microphone 112 is shown to be incorporated on the right side of communication device 100, communication device 100 may include more than one structural microphone. Structural microphone 112 may be activated subsequent to detecting vibration during speech production.

During use of communication device 100, acoustic microphone 110 and structural microphone 112 are configured to receive ambient environmental noise and signal in a periodic fashion, for example, every 1 second. For instance, acoustic microphone 110 and structural microphone 112 may be un-muted to receive signals for a predefined period (e.g., 1 second) follow by 1 second where both acoustic microphone 110 and structural microphone 112 are muted, wherein the muting and un-muting of acoustic microphone 110 and structural microphone 112 is repeated when 100, acoustic microphone 110 and structural microphone 112 are configured is on. Using the ambient environmental noise and signal obtained by acoustic microphone 110 and structural microphone 112 as inputs, a signal-to-noise (SNR) ratio is calculated for each of acoustic microphone 110 and structural microphone 112. In calculating the SNR, the ambient environmental noise and the speech are identified using, for example, zero crossing rate. Once identified, the ambient environmental noise may be separated from the speech. In calculating the SNR, communication device 100 calculates and compares a noise floor from acoustic microphone 110 with a noise floor from the structural microphone 112. When the user of communication device 100 is not speaking, acoustic microphone 110 and structural microphone 112 will only receive ambient environmental noise.

Based on the calculated SNR for each of acoustic microphones 110 and structural microphone 112, one of the acoustic microphone 110 and structural microphone 112 may selected to obtain the speech from the user, wherein the obtained speech is processed in communication device 100 and transmitted from communication device 100 to a communicatively coupled device (referred to herein as a second communication device). For instance, one of acoustic microphones 110 or the structural microphone 112 may be selected to obtain the speech from the user based on the current ambient environmental noise, wherein the selected microphone is put in a ready state or standby mode, wherein in the ready state or standby mode the selected microphone is ready to receive speech input from the user. The user is unaware of which microphone is selected.

Consider an example, where the current ambient environmental noise is relatively loud compared to the speech. In such a case, structural microphone 112 may be selected to obtain the speech from the user. Conversely, when the user's speech is relatively loud when compared to the current ambient environmental noise, one of acoustic microphones 110 may be selected to obtain the speech from the user. When structural microphone 112 is selected to obtain the user's speech, an ambient environmental noise portion of a signal obtained from acoustic microphones 110 may be buffered and, if needed, attenuated. The buffered ambient environmental noise portion may be mixed with speech obtained by structural microphone 112 and the mixed buffered ambient environmental noise portion and speech is processed in communication device 100 and transmitted from communication device 100 to the second communication device, thereby improving the speech quality of speech obtained with structural microphone 112.

FIG. 2 is a flow diagram of a method of selecting one of an acoustic microphone and a structural microphone in a communication device in accordance with some embodiments. At 205, both the acoustic microphone and structural microphone in the communication device are configured to periodically receive environmental noise and signal, for example, in 1 second intervals. At 210, using the ambient environmental noise and signal obtained by the acoustic microphones and structural microphone as inputs, one of a first SNR or a speech to noise ratio is calculated for the acoustic microphones and a SNR is calculated for the structural microphone.

At 215, ambient environmental noise from the acoustic microphones is buffered. At 220, the first SNR or the speech-to-noise ratio for the acoustic microphones is compared to the SNR from the structural microphone. At 225, when the first SNR or the speech-to-noise ratio for the acoustic microphones is higher than the SNR from the structural microphone, the acoustic microphones are selected to obtain the speech from the user. At 230, a second SNR or a second speech-to-noise ratio is calculated for each acoustic microphone. At 235, the second SNR or the second speech-to-noise ratio for the right acoustic microphone is compared with the second SNR or the second speech-to-noise ratio for the left acoustic microphone. At 240, when the second SNR or the second speech-to-noise for the left acoustic microphones is higher than the second SNR or the second speech-to-noise from the right acoustic microphone, the left acoustic microphones are selected to obtain the speech from the user. At 245, when the second SNR or the second speech-to-noise for the right acoustic microphones is higher than the second SNR or the second speech-to-noise from the left acoustic microphone, the right acoustic microphones are selected to obtain the speech from the user. At 250, when the first SNR or the speech-to-noise for the acoustic microphones is lower than the SNR from the structural microphone, the structural microphone is selected to obtain the speech from the user. At 255, the buffered ambient environmental noise is added to the structural microphone and, if necessary, conditioned (for example, making the buffered ambient environmental noise louder or softer depending on the application).

The method described in FIG. 2 is repeated on a period basis, for example, every minute. Consider an example where the user of the communication device is speaking while moving from an environment where the ambient environmental noise is relatively louder than the user's speech. In such as case, both the acoustic microphones and the structural microphone will obtain signals on a predefined periodic basis and in a coordinated manner. As the user speaks while moving, for example, from a noisy environment to a less noisy environment, the acoustic microphones and the structural microphone will receive two types of signals, the speech signal from the user and the ambient environmental noise signal, at the same time. Based on the received signals, a speech-to-noise ratio for the speech signal and a SNR for the ambient environmental noise signal are calculated for the acoustic microphones and the structural microphone. If the speech-to-noise ratio picked up by the acoustic microphones is higher than the SNR for the environmental noise picked up by the structural microphone, the acoustic microphones are selected and put in the standby mode.

When the acoustic microphones are selected, the acoustic microphone with a higher speech-to-noise ratio is selected. Consider for example, that the user is turning his head to a side with acoustic microphone 110*a*. In this case, the speech-to-noise ratio calculated from acoustic microphone 110*a* will be higher than the speech-to-noise ratio calculated from acoustic microphone 110*b* (i.e., the acoustic microphone on the opposite side of where the user's head is facing). Therefore, acoustic microphone 110*a* will be selected and put in the standby mode.

While the user continues to speak, in the event the user is moving towards a more noisy environment, the conditions under which the acoustic microphone is selected may change, for example, the SNR may be higher than the speech-to-noise ratio, causing the structural microphone to be selected and put in the standby mode. As noted previously, the structural microphone requires the coupling of vibration. Because the structural microphone is attached to the neck, the structural microphone will receive the proper vibration coupling of the speech signal. However, the structural microphone may not detect ambient environmental noise that is non-coupling to the structural microphone. Therefore, the speech obtained with the structural microphone may have low or no ambient environmental noise. The lack of ambient environmental noise affects the naturalness of the communication received from the communication device. Accordingly, a low level of ambient environmental noise buffered from the acoustic microphones may be added in to the structural microphone to improve the natural quality of the communication received from communication device.

Figure 3:
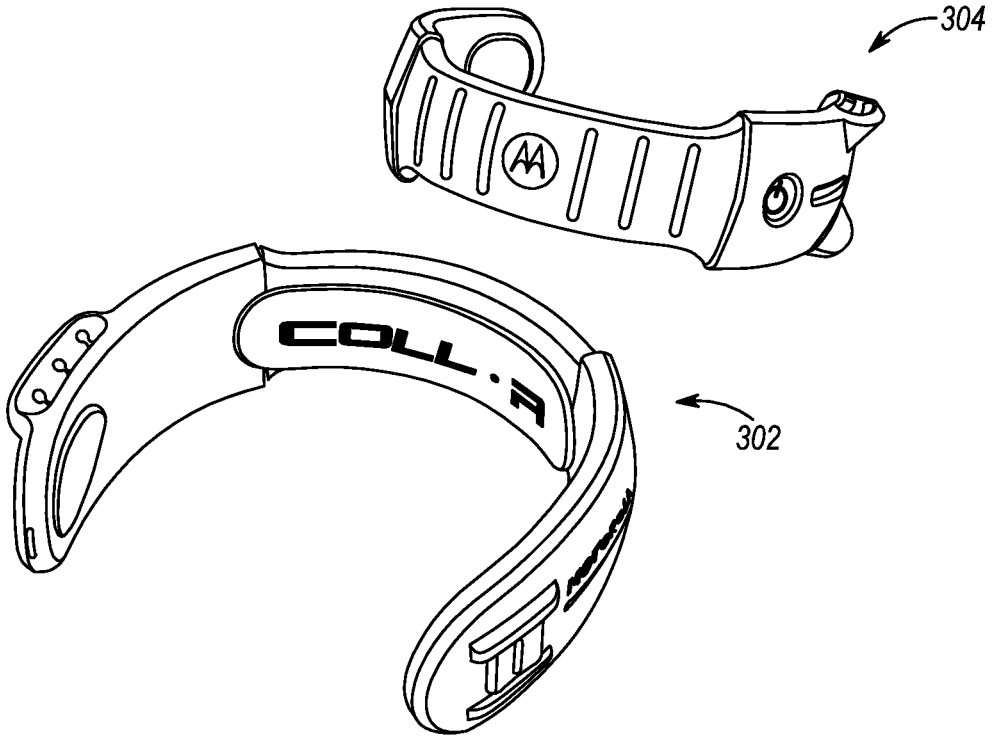
FIG. 3 is an overview of the communication device used in accordance with some embodiments.

FIG. 3 is an overview of the communication device used in accordance with some embodiments. 302 shows a front view of the communication device and 304 shows a rear view of the communication device.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A method comprising:

receiving, by a communication device, signals using at least one acoustic microphone and at least one structural microphone, the communication device being a hands-free, neck-wearable device, wherein the at least one structural microphone is wearable on a neck portion of the communication device and the at least one acoustic microphone is incorporated in a right tip and a left tip of the communication device, thereby providing handsfree operation;

calculating, by the communication device, one of first a signal-to-noise (SNR) ratio and a speech-to-noise ratio for the at least one acoustic microphone from received signals and calculating a SNR for the at least one structural microphone from received signals;

comparing, by the communication device, one of the first SNR and the speech-to-noise ratio for the at least one acoustic microphone with the SNR for the at least one structural microphone; and selecting, by the communication device, one of the at least one acoustic microphone and at least one structural microphone to receive speech responsive to the comparing and placing a selected one of the at least one acoustic microphone and at least one structural microphone in a standby mode.

2. The method of claim 1, further comprising buffering an ambient environmental noise portion retrieved from the signals received by the at least one acoustic microphone and wherein, when the at least one structural microphone is selected to receive speech, a buffered ambient environmental noise portion is mixed with speech obtained by the at least one structural microphone.

3. The method of claim 1, wherein the selecting comprises one of:

selecting the at least one structural microphone if the SNR for the at least one structural microphone is higher than one of the speech-to-noise ratio and the first SNR for the at least one acoustic microphone; and selecting the at least one acoustic microphone if one of the speech-to-noise ratio and the first SNR for the at least one acoustic microphone is higher than the SNR for the at least one structural microphone.

4. The method of claim 1, wherein if the at least one acoustic microphone is selected:

calculating one of a second SNR and a second speech-to-noise ratio for each of the at least one acoustic microphone;

comparing the one of the second SNR and the second speech-to-noise ratio calculated for each of the at least one acoustic microphone with second SNR and second speech-to noise ratio for the at least one acoustic microphone located cross opposite sides (left/right) of the communication device; and selecting an acoustic microphone on one of a left side and a right side of the communication device with a higher one of the second SNR and the second speech-to-noise ratio.

5. The method of claim 1, wherein the signals include ambient environmental noise and speech and the calculating comprises identifying the ambient environmental noise and the speech and separating the ambient environmental noise from the speech.

6. The method of claim 1, further comprising spacers configured to form the communication device into a shape.

7. The method of claim 1, further comprising speakers configured to broadcast information received by the communication device.

8. The method of claim 1, further comprising a spine mechanism for adjusting spacers, wherein an antenna configured to provide radio frequency coverage is inserted between the spine mechanism.

9. The method of claim 1, wherein the at least one structural microphone and the at least one acoustic microphone are muted and unmuted for a periodic predefined period to receive the signals with which to perform the calculation.

10. The method of 1, wherein the method reduces ambient environmental noise levels received by the acoustic microphone while improving speech quality of speech obtained with the structural microphone.

11. A communication device comprising:

a transceiver;

at least one acoustic microphone and at least one structural microphone, each of which is configured to receive signals;

a processor configured to perform a set of functions including:

calculating one of a first signal-to-noise (SNR) ratio and a speech-to-noise ratio for the at least one acoustic microphone from received signals and calculating a SNR for the at least one structural microphone from received signals;

comparing one of the first SNR and the speech-to-noise ratio for the at least one acoustic microphone with the SNR for the at least one structural microphone; and selecting one of the at least one acoustic microphone and at least one structural microphone to receive speech responsive to the comparing and placing a selected one of the at least one acoustic microphone and at least one structural microphone in a standby mode; and the communication device being a hands-free, neck-wearable device, wherein the at least one structural microphone is wearable on a neck portion of the communication device and the at least one acoustic microphone is incorporated in a right tip and a left tip of the communication device, thereby providing handsfree operation.

12. The communication device of claim 11, wherein the processor is further configured to buffer an ambient environmental noise portion retrieved from the signals received by the at least one acoustic microphone and wherein, when the at least one structural microphone is selected to receive speech, a buffered ambient environmental noise portion is mixed with speech obtained by the at least one structural microphone.

13. The communication device of claim 11, wherein the selecting comprises one of:

selecting the at least one structural microphone if the SNR for the at least one structural microphone is higher than one of the speech-to-noise ratio and the first SNR for the at least one acoustic microphone; and selecting the at least one acoustic microphone if one of the speech-to-noise ratio and the first SNR for the at least one acoustic microphone is higher than the SNR for the at least one structural microphone.

14. The communication device of claim 11, wherein if the at least one acoustic microphone is selected:

calculating one of a second SNR and a second speech-to-noise ratio for each of the at least one acoustic microphone;

comparing one of the second SNR and the second speech-to-noise ratio calculated for each of the at least one acoustic microphone with second SNR and second speech-to noise ratio for the at least one acoustic microphone located across opposite sides (left/right) of the communication device; and selecting an acoustic microphone in one of a right tip and a left tip of the communication device with a higher one of the second SNR and the second speech-to-noise ratio.

15. The communication device of claim 11, wherein the signals include ambient environmental noise and speech and the calculating comprises:

identifying the ambient environmental noise and the speech; and separating the ambient environmental noise from the speech.

16. The communication device of claim 11, further comprising spacers configured to form the communication device into a shape.

17. The communication device of claim 11, further comprising speakers configured to broadcast information received by the communication device.

18. The communication device of claim 11, further comprising a spine mechanism for adjusting spacers, wherein an antenna configured to provide radio frequency coverage is inserted between the spine mechanism.

19. The communication device of claim 11, further comprising at least one of:

a light-emitting diode in both the right and left tips of the communication device to provide lighting; and a push-to-talk button to enable push-to-talk communication.

20. The communication device of claim 11, wherein the at least one structural microphone and the at least one acoustic microphone are muted and unmuted for a periodic predefined period to receive the signals with which to perform the calculation.

21. The communication device of claim 11, wherein the communication device having the processor configured to perform the set of functions thereby reduces the ambient environmental noise level received by the acoustic microphone while improving speech quality of speech obtained with the structural microphone.

* * * * *